US012134881B2

(12) United States Patent
Lee

(10) Patent No.: US 12,134,881 B2
(45) Date of Patent: Nov. 5, 2024

(54) EXCAVATION LEVEL DETECTION DEVICE

(71) Applicant: GUGUSYSTEM CO., LTD., Pohang-si (KR)

(72) Inventor: Sang Ryong Lee, Gyeongju-si (KR)

(73) Assignee: GUGUSYSTEM CO., LTD. (KR)

( * ) Notice: Subject to any disclaimer, the term of this patent is extended or adjusted under 35 U.S.C. 154(b) by 305 days.

(21) Appl. No.: 17/787,371

(22) PCT Filed: Dec. 16, 2020

(86) PCT No.: PCT/KR2020/018404
§ 371 (c)(1),
(2) Date: Jun. 20, 2022

(87) PCT Pub. No.: WO2021/145575
PCT Pub. Date: Jul. 22, 2021

(65) Prior Publication Data

US 2023/0029071 A1 Jan. 26, 2023

(30) Foreign Application Priority Data

Jan. 13, 2020 (KR) ..... 10-2020-0004272

(51) Int. Cl.
*E02F 9/26* (2006.01)
*E02F 9/20* (2006.01)

(52) U.S. Cl.
CPC ..... *E02F 9/264* (2013.01); *E02F 9/2029* (2013.01)

(58) Field of Classification Search
CPC ..... E02F 9/2029; E02F 9/264; E02F 3/435; E02F 9/2045; E02F 9/205; E02F 9/2054; E02F 9/262; E02F 9/265; G05D 1/0231; G05D 1/0291; G06Q 10/063; G06Q 50/08; H04Q 9/00
See application file for complete search history.

(56) References Cited

U.S. PATENT DOCUMENTS

| | | | | |
|---|---|---|---|---|
| 2014/0277956 | A1* | 9/2014 | Morin | G01C 21/20 701/50 |
| 2015/0225923 | A1* | 8/2015 | Wallace | E02F 9/264 701/50 |
| 2019/0066323 | A1* | 2/2019 | Li | G06F 18/22 |
| 2021/0148083 | A1* | 5/2021 | Taylor | E02F 9/2029 |

FOREIGN PATENT DOCUMENTS

| | | | | |
|---|---|---|---|---|
| AU | 2019292458 | B2 * | 8/2022 | E02F 9/205 |
| CA | 2991844 | C * | 8/2020 | E02F 3/43 |
| CN | 108138459 | A * | 6/2018 | E02F 3/28 |
| DE | 102019208302 | A1 * | 1/2020 | E02F 3/7609 |
| JP | 2008-274585 | A | 11/2008 | |
| KR | 10-2002-0065623 | A | 8/2002 | |
| KR | 10-2016-0001869 | A | 1/2016 | |
| KR | 10-2018-0093825 | A | 8/2018 | |
| KR | 10-2125664 | A | 6/2020 | |
| WO | WO-2014138951 | A1 * | 9/2014 | E02F 3/434 |
| WO | WO-2020003633 | A1 * | 1/2020 | E02F 9/205 |
| WO | WO-2020090985 | A1 * | 5/2020 | B60R 1/00 |

* cited by examiner

*Primary Examiner* — Babar Sarwar

(57) ABSTRACT

Disclosed is a detection device. The detection device may include: an acquisition unit for acquiring posture information of a work implement having at least one of a bucket, an arm, and a boom of construction equipment; and a first communication unit for wirelessly transmitting the posture information to an interface unit on which level information of the work implement is displayed.

11 Claims, 11 Drawing Sheets

P

ST : 98.1 : 47 : -70 : 30 : 40 : 50 : 4124.8963, N : 08151.6838, W : 280.2M : 170 : 1 : 0 : 1 : END

FIG. 5

(1) Excavator specification setting
(2) State display window 1
(3) Function mode
(4) Command window
(5) State display window 2

(1) Selected bucket
(2) Menu window
(3) Bucket specification input window
(4) Bucket selection button
(5) Storage button for bucket specification
(6) Web server storage button
(7) Closing set window and returning to main window (1) Arm 1 specification input
(2) Length error correction (multiplied by real value to a ratio)
(3) Body specification input
(4) Arm 2 specification input
(5) Alarm range value input
(6) Data storage
(7) User information input

EXCAVATION LEVEL DETECTION DEVICE

CROSS-REFERENCE TO RELATED APPLICATIONS

This patent application is a U.S. national stage application of International Application No. PCT/KR2020/018404, filed Dec. 16, 2020 and the entire contents of which are incorporated herein by reference, which claims priority to KR 10-2020-0004272, filed Jan. 13, 2020 and the entire contents of which are incorporated herein by reference.

TECHNICAL FIELD

The present invention relates to a detection device that is capable of detecting or acquiring level information of construction equipment, such as a posture of the construction equipment, a working position thereof, and the like.

BACKGROUND ART

Level measuring tools are used to allow construction equipment to work in accordance with working values designed initially of the construction equipment.

For example, excavators among the construction equipment are heavy construction equipment for digging up the ground, which are earthwork equipment most widely used among various types of construction equipment (excavators, loaders, dozers, etc.). The excavators are used for earthwork as starting work in most of civil engineering and construction processes for road construction, airport construction, site construction, and the like.

In the process of digging up the ground (hereinafter referred to as excavation work) through the excavator to perform the earthwork, it is required to measure a location or area to be excavated and an excavation depth on a construction site. That is, a person for inducing the work of the excavator is put for the excavation work, together with a driver for driving the excavator, and furthermore, a surveying engineer who transmits the excavation depth to the driver, while checking the design drawings of the construction site, is put in to perform manual surveying using an excavation level measuring tool and a surveying rod after the excavation work.

However, if the surveying engineer is directly put in the construction site, carries out the surveying work manually, and thus transmits the surveying result, the excavation work is done under the empirical determination of the driver of the excavator, thereby making it hard to achieve the accuracy in the excavation work. Further, the surveying work is needed whenever the excavation is carried out through the excavator, and accordingly, overall working time is delayed to cause the extension of the construction period.

Recently, an automatic measurement method has been developed and used in foreign countries, and according to the conventional automatic measurement method, sensors are mounted on an excavator. Further, a device for automatically measuring displacement according to the excavation work is mounted on the excavator, thereby allowing a driver of the excavator to directly monitor an excavation depth.

Further, a technology for measuring coordinates without a satellite navigation system (GPS) and acquiring survey information required for works is disclosed in Korean Patent No. 1629716.

DISCLOSURE

Technical Problem

Accordingly, the present invention has been made in view of the above-mentioned problems occurring in the related art, and it is an object of the present invention to provide a detection device that is capable of collecting various posture information of construction equipment and transmitting the collected posture information to an interface unit.

Technical Solution

To accomplish the above-mentioned objects, according to the present invention, there is provided a detection device including: an acquisition unit for acquiring posture information of a work implement having at least one of a bucket, an arm, and a boom of construction equipment; and a first communication unit for wirelessly transmitting the posture information to an interface unit on which level information of the work implement is displayed.

Advantageous Effects

According to the present invention, the detection device can collect the information obtained from various sensors disposed on the construction equipment and wirelessly transmit the collected information to the interface unit.

According to the present invention, it is possible to display the level information for the construction equipment through various types of interface units conforming to the wireless communication standard of the detection device. For example, various types of smart devices, such as smartphones, tablets, and the like, which communicate with the detection device through Bluetooth or Wi-Fi, may be used as the interface unit.

Unlike the existing wired-based monitors, the interface unit, which is prevented from interference with the wired line, may be disposed on various positions in the control room of the construction equipment.

Additionally, the detection device of the present invention can provide the raw data corresponding to the sensor values obtained from the various types of sensors disposed on the construction equipment to the interface unit.

The interface unit may include various types of smart devices that process the corresponding raw data and display the processed data through a pool in which various producers participate, for example, an application registered in Google Play store. The interface unit in which the related application is installed may produce various types of level information from the raw data and display the level information through the menu with various designs.

In consideration of a situation in which a plurality of construction equipment work together, further, the detection device of the present invention may prevent the posture information wirelessly transmitted from a specific detection device of one construction equipment from being incorrectly used in other construction equipment.

BRIEF DESCRIPTION OF DRAWINGS

FIG. 5 is a schematic view showing a first packet format wirelessly transmitted from a first communication unit to an interface unit.

Figure 1:
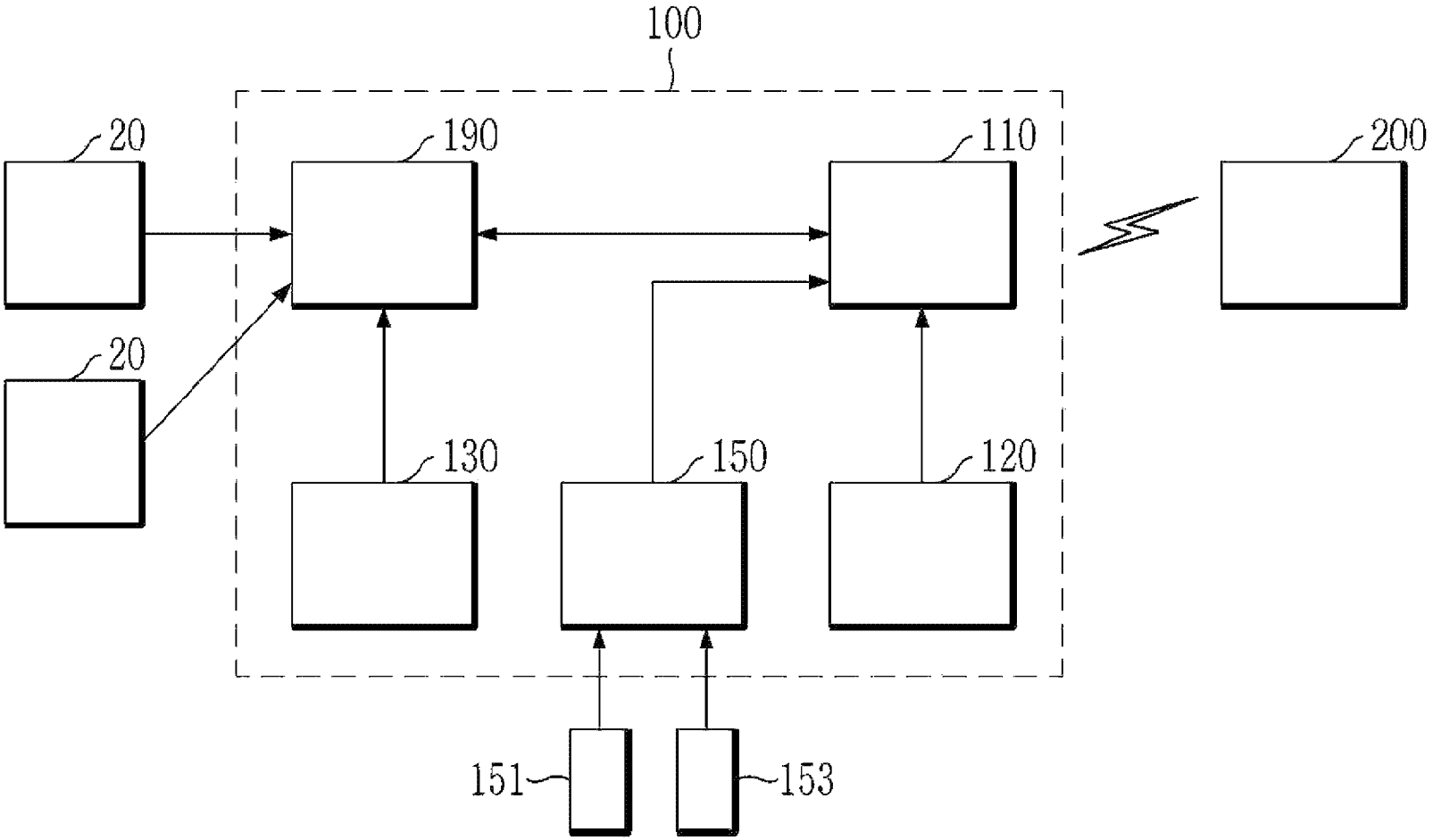
FIG. 1 is a block diagram showing a detection device according to the present invention.

| Explanations of Reference Numerals in the drawing | |
|---|---|
| 1. . .Construction equipment | 2. . .Control room |
| 3. . .Body | 5. . .Boom |
| 7. . .Arm | 9. . .Bucket |
| 20. . .Sensor | 21. . .Tilt sensing means |
| 23. . .Gyro sensing means | 100. . .Detection device |
| 110. . .First communication unit | 150. . .Control unit |
| 120. . .Second communication unit | 153. . .Zero point control pedal |
| 130. . .Position recognizing means | 200. . .Interface unit |
| 151. . .Zero point control button | 230. . .Processing means |
| 190. . .Acquisition unit | |
| 210. . .Display | |
| 250. . .Terminal communication module | |

BEST MODE FOR INVENTION

Hereinafter, an explanation of the present invention will be given in detail with reference to the attached drawings so that embodiments of the present invention can be easily performed by those skilled in the art. However, the present invention can be implemented in many different forms and is not limited to the embodiments described herein.

Figure 2:
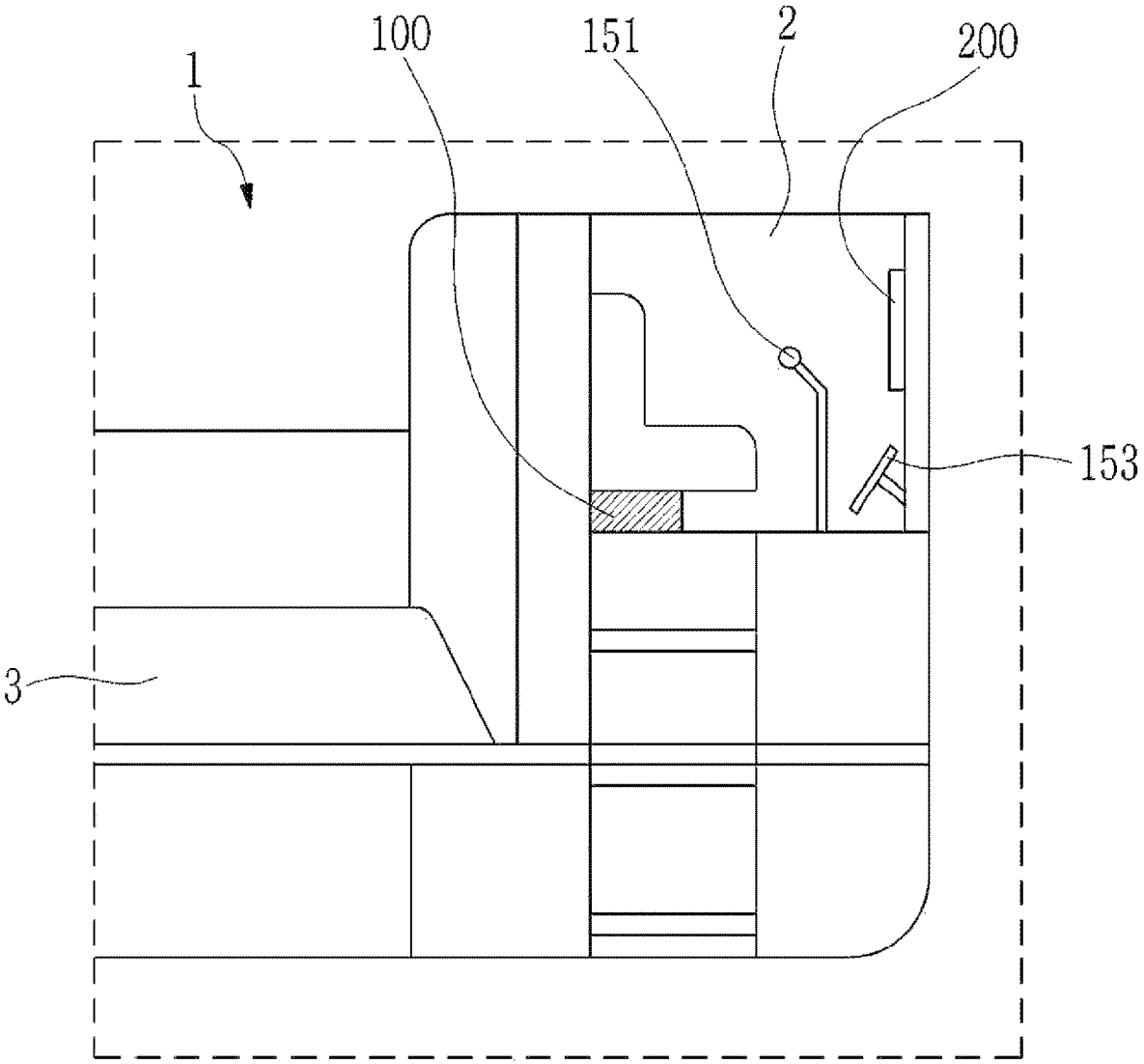
FIG. 2 is a schematic view showing the detection device according to the present invention.

FIG. 1 is a block diagram showing a detection device 100 according to the present invention. FIG. 2 is a schematic view showing the detection device 100 according to the present invention.

As shown, the detection device 100 according to the present invention includes an acquisition unit 190, a first communication unit 110, a second communication unit 120, a position recognizing means 130, and a control unit 150.

The acquisition unit 190 serves to acquire posture information of a work implement having at least one of a bucket 9, an arm 7, and a boom 5 of construction equipment 1.

The construction equipment 1 is one of various types of machines used in construction and civil engineering sites, and may include an excavator, a loader, a crane, a dozer, and the like. The work implement may include various types of booms, arms, and buckets of the construction equipment 1, which actually operate in construction work, excepting wheels or a body 3 supported on the ground. The boom may be a pillar-shaped or rod-shaped member rotatably connected or linearly movably connected to the body 3 with the wheels or the body 3 fixed to the ground. The arm may include various members facing the body 3, while the boom is being interposed therebetween, and the arm may be rotatably connected to the end of the boom. The bucket is disposed on the end of the arm and may include a gourd for digging up the ground or lifting soil. In addition to the gourd, in this specification, the bucket may include various tools disposed on the end of the arm.

The acquisition unit 190 may include sensors 20 directly disposed on the bucket 9, the arm 7, and the boom 5. In this case, the acquisition unit 190 directly acquires posture information. Otherwise, the acquisition unit 190 may acquire posture information by receiving measurement values from the sensors 20.

The posture information may include the length of the boom 5 and the angle of the boom 5 with respect to the body 3.

The posture information may include the length of the arm 7, the angle of the arm 7 with respect to the body 3 or the boom 5.

The posture information may include the length of the bucket 9 and the angle of the bucket 9 with respect to any one of the body 3, the boom 5, and the arm 7.

The length of the boom 5, the length of the arm 7, and the length of the bucket 9 are pre-acquired.

The angle of the boom 5, the angle of the arm 7, and the angle of the bucket 9 are measured through an encoder, tilt sensing means 21, and the like. The tilt sensing means 21 are disposed on the joints of the boom 5, the arm 7, and the bucket 9 to measure the tilt angles of the boom 5, the arm 7, and the bucket 9. The tilt sensing means 21 serve to provide the driving states for the work implements of the construction equipment 1 to a driver and the acquisition unit 190 so that the interface unit 200 measures coordinates.

The acquisition unit 190 additionally acquires the position information of the construction equipment 1 from the position recognizing means 130 such as a global positioning system (GPS) installed in the body or a control room 2 of the construction equipment 1. The position recognizing means 130 is disposed on the acquisition unit 190, a gyro sensing means 23, or the tilt sensing means 21.

The position information may include an x-axis coordinate, a y-axis coordinate, and a z-axis coordinate of the body 3 of the construction equipment 1 in the three-dimensional space formed by an x-axis, a y-axis, and a z-axis orthogonal to one another, an angle of the body 3 rotating around the x-axis, an angle of the body 3 rotating around the y-axis, and an angle of the body 3 rotating around the z-axis. The rotation angles of the body 3 with respect to the x-axis, the y-axis, and the z-axis are obtained through the gyro sensing means 23 or the like. The gyro sensing means 23 is disposed on the body 3 to measure the rotation angles of the body 3 according to the postures of the body 3.

Using the above-mentioned posture information and position information, a current position such as a height or distance of the bucket or arm performing an actual construction work is calculated through the operation using a trigonometric function.

The first communication unit 110 wirelessly transmits the posture information to the interface unit 200 on which level information of the work implement is displayed. The first communication unit 110 wirelessly transmits the position information to the interface unit 200, and in this case, the position information is transmitted separately from the posture information. Otherwise, the first communication unit 110 may include the position information in the posture information to thus transmit the posture information to which the position information is added to the interface unit 200.

For example, the acquisition unit 190 acquires the posture information of the work implements from the sensors disposed on the boom, the arm, and the bucket. The acquisition unit 190 acquires the position information of the construction equipment 1 from the position recognizing means 130 disposed on the body 3 or the control room 2 of the construction equipment 1.

The first communication unit 110 transmits the position information to the interface unit 200. The level information displayed on the interface unit 200 may include at least one of posture information, first processing information of the posture information, position information, second processing information of the position information, and third processing information based on both of the posture information and the position information.

For example, the angle information of the bucket among the posture information represents the angle of the bucket with respect to the arm. The posture information as the level information is displayed on the interface unit 200. Further, the angle information of the arm among the posture information represents the angle of the arm with respect to the boom. In this case, if the angle information of the bucket and the angle information of the arm are appropriately calculated, the angle of the bucket with respect to the boom can be obtained. Like this, the result values obtained by calculating the posture information as inputs correspond to the processing information.

The first processing information may include the result value calculated based on the posture information.

The second processing information may include the result value calculated based on the position information.

The third processing information may include the result value calculated based on both of the posture information and the position information.

Figure 3:
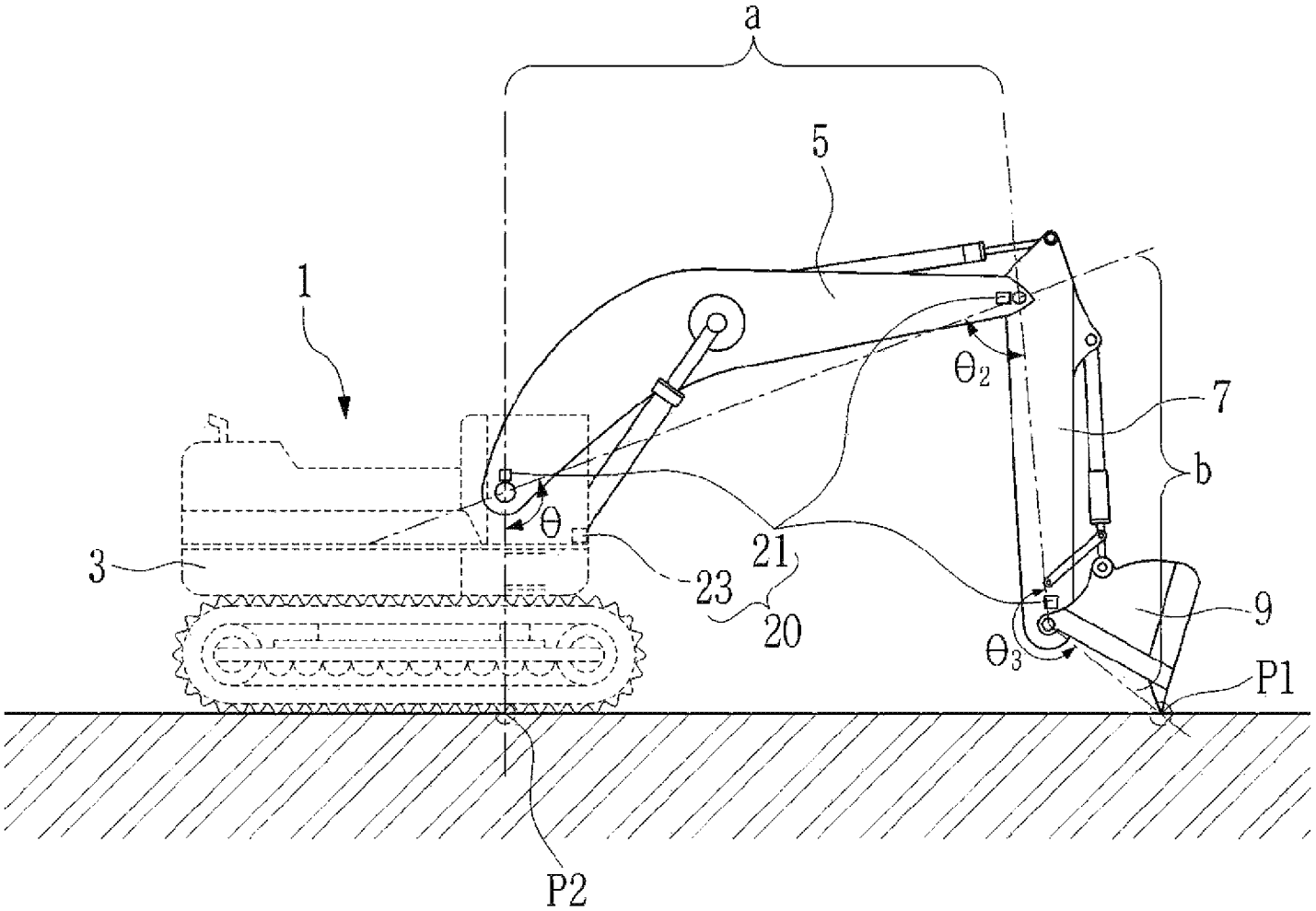
FIGS. 3 and 4 are schematic views showing posture information and processing information.
Figure 4:
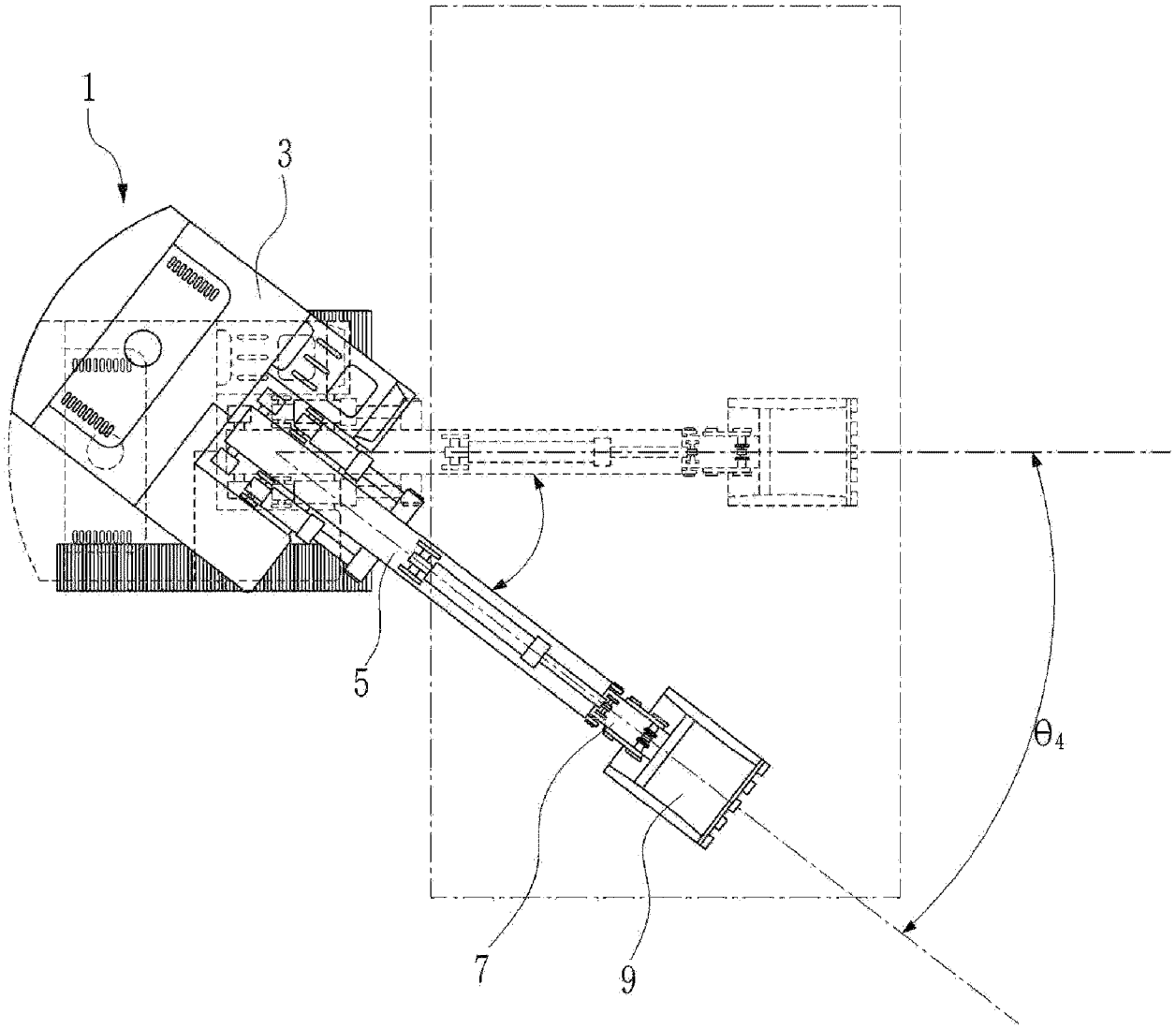

FIGS. 3 and 4 are schematic views showing the posture information and the processing information.

The plurality of tilt sensing means 21 may be provided. The tilt sensing means 21 serve to measure the angle θ1 of the boom with respect to the body 3, the angle θ2 between the boom and the arm, and the angle θ3 between the arm 7 and the bucket, respectively. In specific, one of the tilt sensing means 21 is disposed on the joint where the body 3 and the boom are connected to each other to thus measure the angle θ1 between the body 3 and the boom. Another tilt sensing means 21 is disposed on the joint where the boom and the arm are connected to each other to thus measure the angle θ2 of the boom and the arm. The other tilt sensing means 21 is disposed on the joint where the arm and the bucket are connected to each other to thus measure the angle θ3 between the arm and the bucket.

The gyro sensing means 23 detects whether the body 3 of the construction equipment 1 rotate by rotational motion. The gyro sensing means 23 measures a rotation angle θ4 through the rotational motion of the body 3. The gyro sensing means 23 serves to detect the posture of the body 3 rotating in a true north direction, that is, with respect to a vertical axis in the body 3 designed to rotatably operate in the construction equipment 1 to thus measure the rotation angle θ4. In an embodiment of the present invention, the gyro sensing means 23 measures the rotation angle θ4 around the z-axis parallel to the direction of gravity. In addition, the gyro sensing means 23 may measure the rotation angle around the x-axis and the rotation angle around the y-axis.

The interface unit 200, which receives at least one of the posture information and the position information, may measure the coordinates of a reference point P2 (the reference point of the work implement) with respect to the position of the body 3, based on the measured values obtained from the sensors 20 such as the tilt sensing means 21 and the gyro sensing means 23.

The interface unit 200 wirelessly receives the posture information or position information from the first communication unit 110 and processes the received information to thus produce level information. The level information may include numerical information that a user directly refers to during construction work such as excavation. For example, the level information may include current spatial coordinates of the bucket.

The interface unit 200 measures the reference coordinates of the body 3 located for the excavation work, and in this case, the interface unit 200 sets the point where the bucket is located as an initial reference point P1 and then measures the coordinates of the work implement reference point P2 as the fixed position of the body 3 by using the angles θ1, θ2, and θ3 obtained from the tilt sensing means 21 with respect to the initial reference point P1 and the pre-recognized lengths a, b, and c of the work implements.

The coordinates of the initial reference point P1 are measured by an operator and inputted through the interface unit 200.

The interface unit 200 measures new position coordinates of the bucket which are changed according to the rotational motions of the body 3. That is, the interface unit 200 measures the position coordinates of the bucket with respect to the body 3 of the construction equipment 1 after the body 3 rotates around the work implement reference point P2.

The interface unit 200 calculates the coordinates of the work implement reference point P2 through the lengths of the respective work implements existing between the bucket and the body 3 and the angles θ1, θ2, and θ3 obtained from the tilt sensing means 21. In specific, the interface unit 200 measures the position of the body 3 from the initial reference point P1 at which the bucket is located through the lengths a, b, and c obtained by the pre-stored fixed length values of the boom, arm, and bucket of the construction equipment 1 and the angles θ1, θ2, and θ3 of the boom, the arm and the bucket received from the tilt sensing means 21, thereby calculating the coordinates of the work implement reference point P2. The work implement reference point P2 may include an x-axis position, a y-axis position, and a z-axis position. The work implement reference point P2 may further include a rotation angle based on the respective axes.

The interface unit 200 continuously performs operations so that the coordinates for the position of the bucket with respect to the work implement reference point P2 where the body 3 is located are continuously measured. Accordingly, the sensors 20, the acquisition unit 190, and the first communication unit 110 provide the posture information to the interface unit 200 in real time.

If the rotation of the body 3 is detected from the gyro sensing means 23, the interface unit 200 may re-measure and calculate the coordinates of the bucket changed in position by the rotation of the body 3.

According to the present invention, the first communication unit 110 communicates with various types of interface units 200 equipped with a communication module that satisfies a set protocol.

An example of a packet conforming to the set protocol is shown in FIG. 5.

FIG. 5 is a schematic view showing a first packet format wirelessly transmitted from the first communication unit 110 to the interface unit 200. The first packet format may be a serial merge data format.

The first communication unit 110 assigns identifiers to pieces of detailed information constituting the posture information. The first communication unit 110 wirelessly transmits the packet including the identifiers and the pieces of detailed information to the interface unit 200. The identifiers may be used in restoring the posture information through the combination of the pieces of detailed information in the interface unit 200.

For example, the first communication unit 110 produces a packet P where start notification 'ST', the angle of the boom '98.1', the angle of the arm '47', the angle of the bucket '−70', the x-axis angle of the body 3 '30', the y-axis angle of the body 3 '40', the z-axis angle of the body 3 '50', the latitude of the body 3 '4124.3963,N', the longitude of the body 3 '08151.6838,W', the altitude of the body 3 '280.2M', the azimuth of the body 3 '170', other information '1', '0', '1', and end notification 'END' are arranged in the order mentioned. In this case, the plurality of detailed items may be distinguished from one another by the identifiers such as ':', and the like.

The first communication unit 110 serves to packetize the various posture information and position information obtained from the sensors 20 according to the set protocol format. Accordingly, the first communication unit 110 wirelessly transmits the corresponding packet to the interface unit 200.

If the packet as shown in FIG. 5 is received, the interface unit 200 operating according to the set protocol recognizes 'ST' as the start notification. The interface unit 200 immediately recognizes the numerical value '98.1' behind the 'ST' as the angle of the boom. The interface unit 200 recognizes '47' after '98.1' as the angle of the arm. The interface unit 200 recognizes '−70' after '47' as the angle of the bucket. The interface unit 200 recognizes '30' after '−70' as the x-axis angle of the body 3. The interface 200 recognizes '40' after '30' as the y-axis angle of the body 3. The interface unit 200 recognizes '50' after '40' as the z-axis angle of the body 3. The interface unit 200 recognizes '4124.3963,N' after '50' as the latitude of the body 3. The interface unit 200 recognizes '08151.6838,W' after '4124.3963,N' as the longitude of the body 3. The interface unit 200 recognizes '280.2M' after '08151.6838,W' as the altitude of the body 3. The interface unit 200 recognizes '170' after '280.2M' as an azimuth of the body 3. The interface unit 200 recognizes '1', '0', and '1' after '170' as other information such as a zero point signal. If 'END' is detected, the interface unit 200 determines that the corresponding packet has ended.

Figure 6:
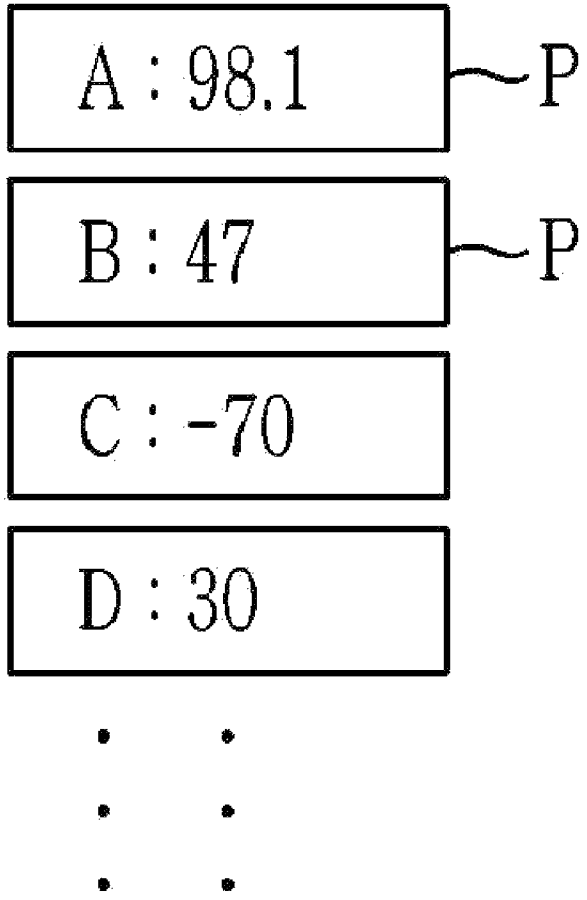
FIG. 6 is a schematic view showing a second packet format wirelessly transmitted from the first communication unit to the interface unit.

FIG. 6 is a schematic view showing a second packet format wirelessly transmitted from the first communication unit 110 to the interface unit 200.

The first communication unit 110 assigns unique identifiers to the respective pieces of detailed information constituting the level information.

The first communication unit 110 wirelessly transmits a packet P having a unique identifier and one of the pieces of detailed information as one set to the interface unit 200.

For example, the first communication unit 110 may assign a first identifier A to the angle of the boom. The first identifier A matches 98.1 as a measured value for the angle of the boom, so that the packet P as a set with the first identifier A and the measured value of '98.1' is produced. Accordingly, the first communication unit 110 wirelessly transmits the packet P to the interface unit 200.

The first communication unit 110 may assign a second identifier B to the angle of the arm. The second identifier B matches 47 as a measured value for the angle of the arm, so that the packet P as a set with the second identifier B and the measured value of '47' is produced. Accordingly, the first communication unit 110 wirelessly transmits the packet P to the interface unit 200.

The first communication unit 110 may assign a third identifier C to the angle of the bucket. The third identifier C matches −70 as a measured value for the angle of the bucket, so that the packet P as a set with the third identifier C and the measured value of '−70' is produced. Accordingly, the first communication unit 110 wirelessly transmits the packet P to the interface unit 200.

The first communication unit 110 may assign a fourth identifier D to the angle of the x-axis. The fourth identifier D matches 30 as a measured value for the angle of the x-axis, so that the packet P as a set with the fourth identifier D and the measured value of '30' is produced. Accordingly, the first communication unit 110 wirelessly transmits the packet P to the interface unit 200.

Under the above-mentioned sequential parallel data format method, data are transmitted to the interface unit 200 at a high speed.

The unique identifiers are used in restoring the posture information through the combination of the pieces of detailed information in the interface unit 200. In the process of restoring the posture information, each identifier may include time information so that the packet at a first time point and packet at a second time point are not mixed with each other.

For example, the bucket angle packet produced at the first time point may include the identifier C, time information t1, and the sensed value of −70. The bucket angle packet produced at the second time point may include the identifier C, time information t2, and the sensed value of −72. The unique identifiers serve to divide and restore the pieces of detailed information, and further, the same identifiers are given to the same kind of pieces of detailed information. The same kind of pieces of the detailed information are based on the sensed values produced with a time difference from the same sensor 20 as each other, and if the time during which the sensed values are produced is added, accordingly, the same kind of pieces of detailed information are divided by time. Instead of having the same time information, accordingly, the interface unit 200 may collect packets having different identifiers from one another to thus restore the posture information at the time points represented by the time information.

To supply the power required for the operations of the sensors 20, the sensors 20 are wiredly connected to the acquisition unit 190. The acquisition unit 190 provides the control signals and driving power to the sensors 20 through wire lines. For example, the acquisition unit 190 may be electrically connected to the wire line connected to the end sensor 20 disposed on the end of the arm or the bucket. Otherwise, the acquisition unit 190 may be connected to the wire line connected to the middle sensor 20 disposed on the center of the arm or the boom.

The first communication unit 110 receives the posture information from the acquisition unit 190 and wirelessly transmits the posture information to the interface unit 200 disposed in the control room 2 of the construction equipment 1.

The interface unit 200 provides level information that a user can refer to when the user works with the construction equipment 1. To provide the level information for the user, the interface unit 200 is disposed in the control room 2 where the user is located. If the acquisition unit 190 and the first communication unit 110 are mounted in a single casing, the wire lines exposed to the outside may exist only between the sensors 20 and the acquisition unit 190. According to an embodiment of the present invention, the interface unit 200 disposed in the control room 2 is basically prevented from interference with the wire lines, and accordingly, it may be disposed on various positions. In addition, the user's field of view cannot be obstructed by the wire line connected to the interface unit 200. Moreover, the user can freely select and use his or her desired interface unit 200.

The acquisition unit 190 and the first communication unit 110 are mounted together in one casing disposed in the control room 2 of the construction equipment 1. In this case, the acquisition unit 190 is wiredly connected to the sensors 20 for sensing the posture information, for example, the tilt sensing means 21 or to the position recognizing means 130. The first communication unit 110 wirelessly transmits the posture information to the interface unit 200 disposed in the control room 2. According to an embodiment of the present invention, the acquisition unit 190 and the first communication unit 110 may be disposed in the control room 2, together with the interface unit 200. As a result, the communication between the first communication unit 110 and the interface unit 200 can be accurately and quickly performed despite the construction site where various facilities interfering with the progress of radio waves are located.

Figure 7:
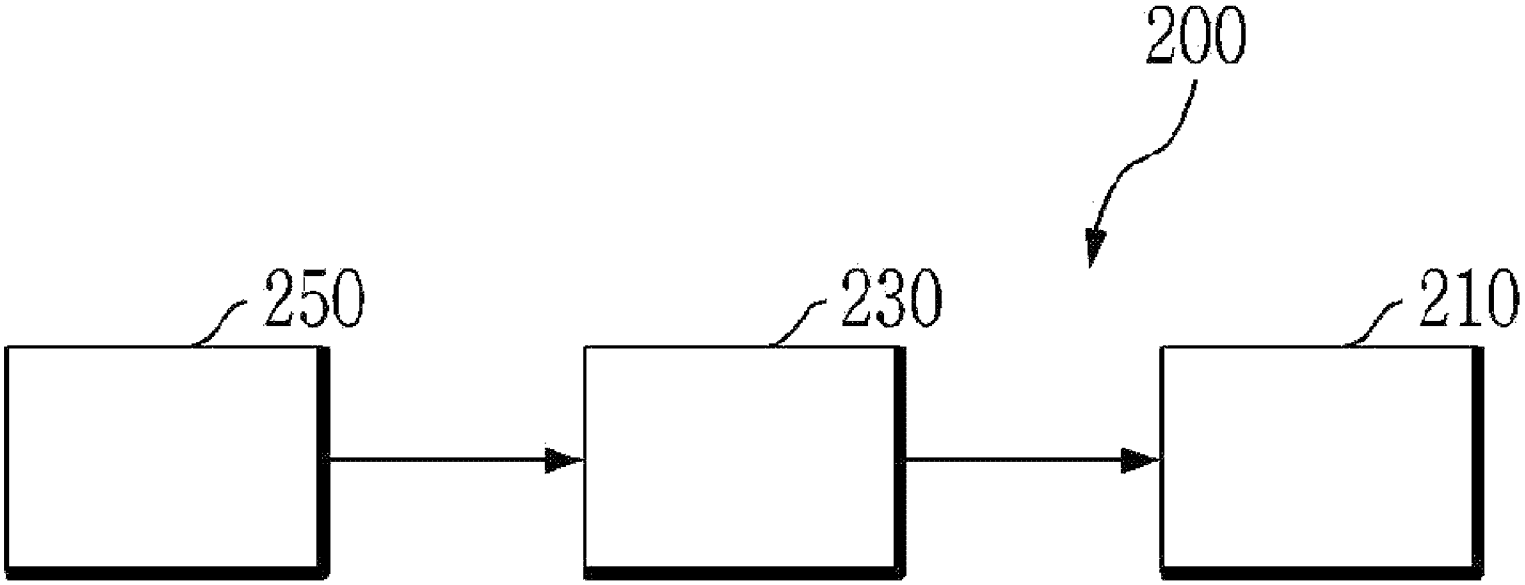
FIG. 7 is a schematic view showing the interface unit of the detection device according to the present invention.

FIG. 7 is a schematic diagram showing the interface unit 200.

The interface unit 200 may include a smart device that is provided with a display 210, a processing means 230 for processing posture information to be displayed on the display 210, and a terminal communication module 250 in wireless communication with the first communication unit 110.

The processing unit 230 converts the posture information into the level information that can be displayed on the display 210 using a level application corresponding to pre-distributed software.

The terminal communication module 250 transmits the posture information to the first communication unit 110 using Bluetooth or Wi-Fi. The terminal communication module 250 transmits the posture information according to a protocol defined in the level application. According to an embodiment of the present invention, if the corresponding level application is not installed, the interface unit 200 cannot communicate with the first communication unit 110.

The smart device having the display 210, the processing means 230, and the terminal communication module 250 may include a smart phone and a tablet having the display 210 of 7 inches or more. The user freely selects his or her desired smart device, downloads the level application to the selected smart device through a simple procedure, and provides the interface unit 200 that can communicate with the first communication unit 110 and display the level information.

In consideration of a work situation in which multiple construction equipment 1 work together, further, there is a need to prevent the posture information of one specific construction equipment 1 from having influence on other construction equipment or other smart devices.

For example, the first communication unit 110 provides unique information to the interface unit 200.

The first communication unit 110 provides posture information only to the specific interface unit 200 whose integrity for the unique information is authenticated.

For example, it is assumed that the first communication unit 110 uses a Bluetooth network.

If the user activates the Bluetooth communication of the interface unit 200, the terminal communication module 250 of the interface unit 200 displays the devices capable of performing Bluetooth communication on the display 210. In this case, the first communication unit 110 may be included among the devices displayed on the display 210. The first communication unit 110 provides the unique information distinguished from other devices to the interface unit 200, and the corresponding unique information is displayed on the interface unit 200. The user distinguishes the first communication unit 110 or the detection device 100 from other devices through the unique information displayed on the display 210.

The unique information may also be displayed on other adjacent smart devices using the Bluetooth network. In this case, the first communication unit 110 requests the input of a specific authentication key from the smart device that has selected the unique information, so that the level information cannot be displayed on other adjacent smart devices.

The first communication unit 110 transmits the posture information to the smart device to which the specific authentication key is normally inputted. The smart device to which the specific authentication key is normally inputted corresponds to the interface unit 200 of the present invention.

Further, a method of matching the interface unit 200 and the first communication unit 110 disposed in the control room 2 one-to-one may be provided regardless of whether the unique information is provided or the integrity is authenticated through the authentication key input.

For example, a communication threshold range where communication is possible in the first communication unit 110 is determined within the range of a width and a length of the construction equipment 1. In specific, the communication radius of the first communication unit 110 is limited to within 2 to 3 meters. In addition, if the first communication unit 110 is disposed in the control room 2, only the interface unit 200 disposed in the control room 2 can normally communicate with the first communication unit 110.

According to an embodiment of the present invention, the first communication unit 110 normally matches the interface unit 200 one-to-one, without the use of the separate unique information or the authentication key.

Referring back to FIG. 1, the control unit 150 produces a zero point signal through the user's control.

When the user calibrates the zero point of the work implement, it is inconvenient to control a zero point control menu displayed on the interface unit 200. Accordingly, an input means related to zero point control is desirably provided near a lever or pedal controlled to move the construction equipment 1.

Like this, the control unit 150, which is provided separately from the interface unit 200, is used to produce the zero point signal.

The zero point signal produced by the control unit 150 is provided to the interface unit 200 through the first communication unit 110. The zero point signal controls the interface unit 200 to allow specific level information being currently displayed on the interface unit 200 to be set to a reference value, for example, '0'. As a result, the control unit 150 produces the zero point signal so that the interface unit 200 is controlled to allow the specific level being currently displayed to be set to the reference value.

For example, if the zero point signal is produced, the first communication unit 110 provides the zero point signal as well as the posture information to the interface unit 200.

The first communication unit 110 additionally provides the zero point signal to the interface unit 200 where the posture information is provided in real time. Otherwise, the first communication unit 110 matches the specific posture information acquired through the acquisition unit 190 at the time when the zero point signal is produced and the zero point signal and provides the specific posture information and the zero point signal matching each other to the interface unit 200.

The interface unit 200 sets the level information based on the posture information provided from the first communication unit 110 together with the zero point signal as an initial value. Otherwise, the interface unit 200 may set the level information being displayed through the display 210 as an initial value at the time when the zero point signal is obtained from the first communication unit 110.

As shown in FIG. 2, the control room 2 of the construction equipment 1 is provided with a zero point control button 151 that can operate by the user's hand or a zero point control pedal 153 that can operate by the user's foot.

The control unit 150 produces the zero point signal if the zero point control button 151 or the zero point control pedal 153 operates by the user. The zero point signal produced from the control unit 150 is transmitted to the interface unit 200 through the first communication unit 110.

For example, in a state where the control lever of the work implement operates to allow the end of the bucket to come into close contact with the ground, if the zero point control button 151 or the zero point control pedal 153 operates by the user, the current coordinate value of the bucket can be set to '0'. Subsequent level information is displayed as relative coordinates to the coordinate value of the bucket set to '0'. According to an embodiment of the present invention, ground leveling work can be easily performed.

If the multiple construction equipment 1 work together, moreover, it is preferable that the multiple construction equipment 1 are set to zero point, together. So as to allow the multiple construction equipment 1 to be set to zero point, together, the detection device 100 is desirably provided with the second communication unit 120.

The second communication unit 120 communicates with other construction equipment. The second communication unit 120 is mounted in the same casing together with the acquisition unit 190 and the first communication unit 110. The second communication unit 120 uses a communication network capable of wireless communication up to several tens of meters or several kilometers. For example, the second communication unit 120 communicates with other construction equipment through a medium to long range communication network such as a low-power wide-area network.

The first communication unit 110 transmits the specific posture information provided to the interface unit 200 or obtained through the acquisition unit 190 at the time when the zero point signal is produced to the second communication unit 120. In this case, further, the first communication unit 110 provides the specific posture information to the interface unit 200 located within a short range.

The second communication unit 120 transmits the specific posture information received from the first communication unit 110 to other construction equipment.

According to the above-mentioned embodiment of the present invention, the second communication unit 120 transmits the specific posture information received from the first communication unit 110 to other construction equipment.

To the contrary, if specific posture information is transmitted from other construction equipment, the second communication unit 120 receives the specific posture information. In this case, if the specific posture information is received from other construction equipment through the second communication unit 120, the control unit 150 produces the zero point signal. The zero point signal is produced from the control unit 150 through the user's control in the above-mentioned embodiment of the present invention, and in the embodiment of the present invention, the zero point signal is produced from the control unit 150 by triggering the specific posture information received from other construction equipment.

The first communication unit 110 transmits the zero point signal produced by the control unit 150 and the specific posture information of other construction equipment received through the second communication unit 120 to the interface unit 200.

The zero point signal controls the interface unit 200 to allow the specific level information where the specific posture information is included to be set as a reference value. According to an embodiment of the present invention, if the zero point is set by the user's control in any one of the multiple construction equipment 1, the corresponding zero point is automatically set in the remaining construction equipment 1.

According to the present invention, the first communication unit 110 provides only the posture information corresponding to the raw data to the interface unit 200. The interface unit 200 performs various operations using the posture information as an input and displays the level information corresponding to the result value on the display 210. The operations performed in the interface unit 200, menus displayed on the display 210, and the like may be defined or produced by an application. The application can be made with a variety of designs or formats by various users.

Figure 8:
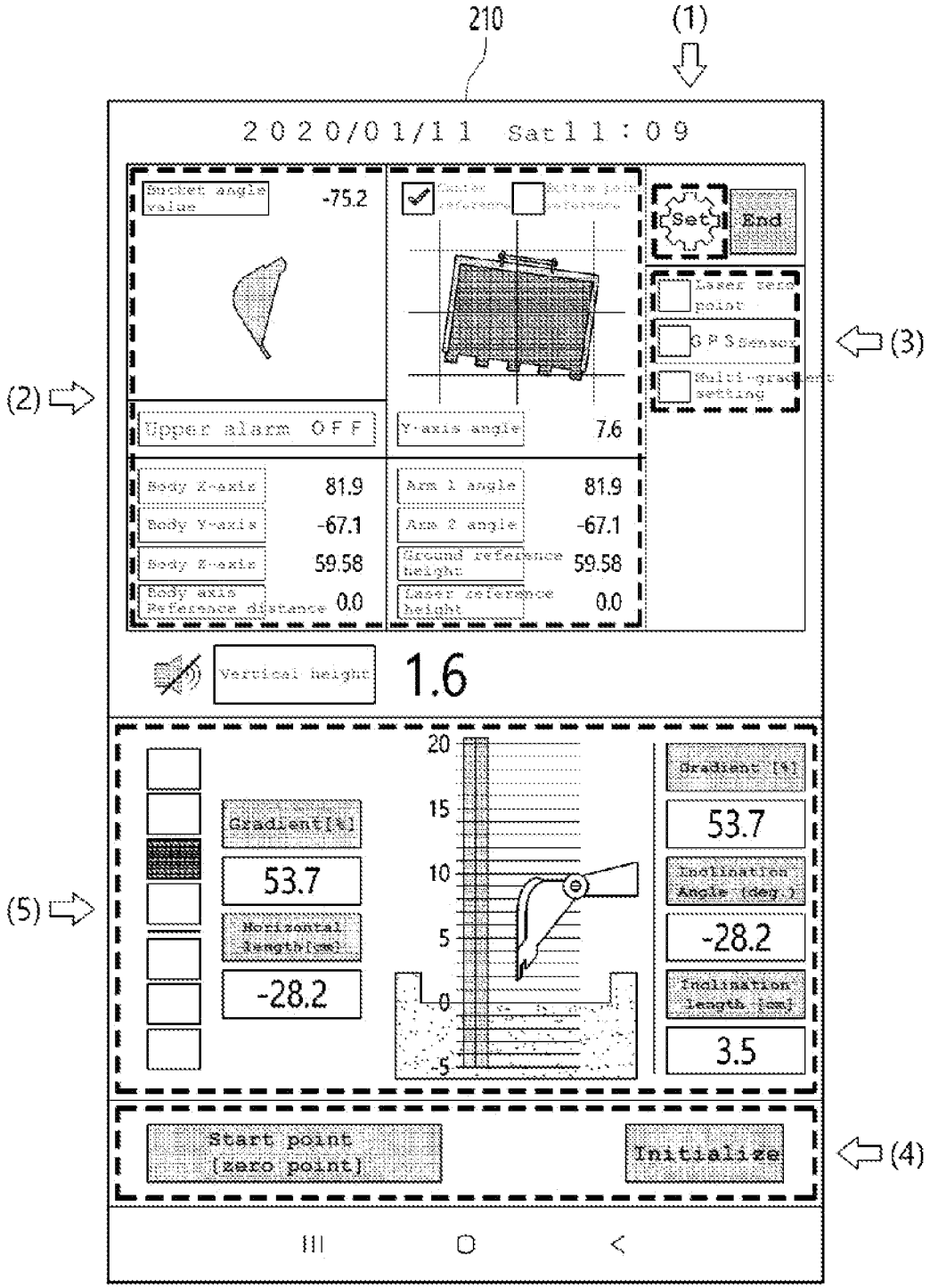
FIG. 8 is a schematic view showing a main screen displayed on the interface unit.

FIG. 8 is a schematic diagram showing a main screen displayed on the interface unit 200.

The main screen includes a first main menu (1) for setting the specification of the construction equipment 1, a second main menu (2) for displaying a first state of the construction equipment 1, a third main menu (3) for setting the functions of the interface unit 200, a fourth main menu (4) for representing a command window, and a fifth main menu (5) for displaying a second state of the construction equipment 1.

Figure 9:
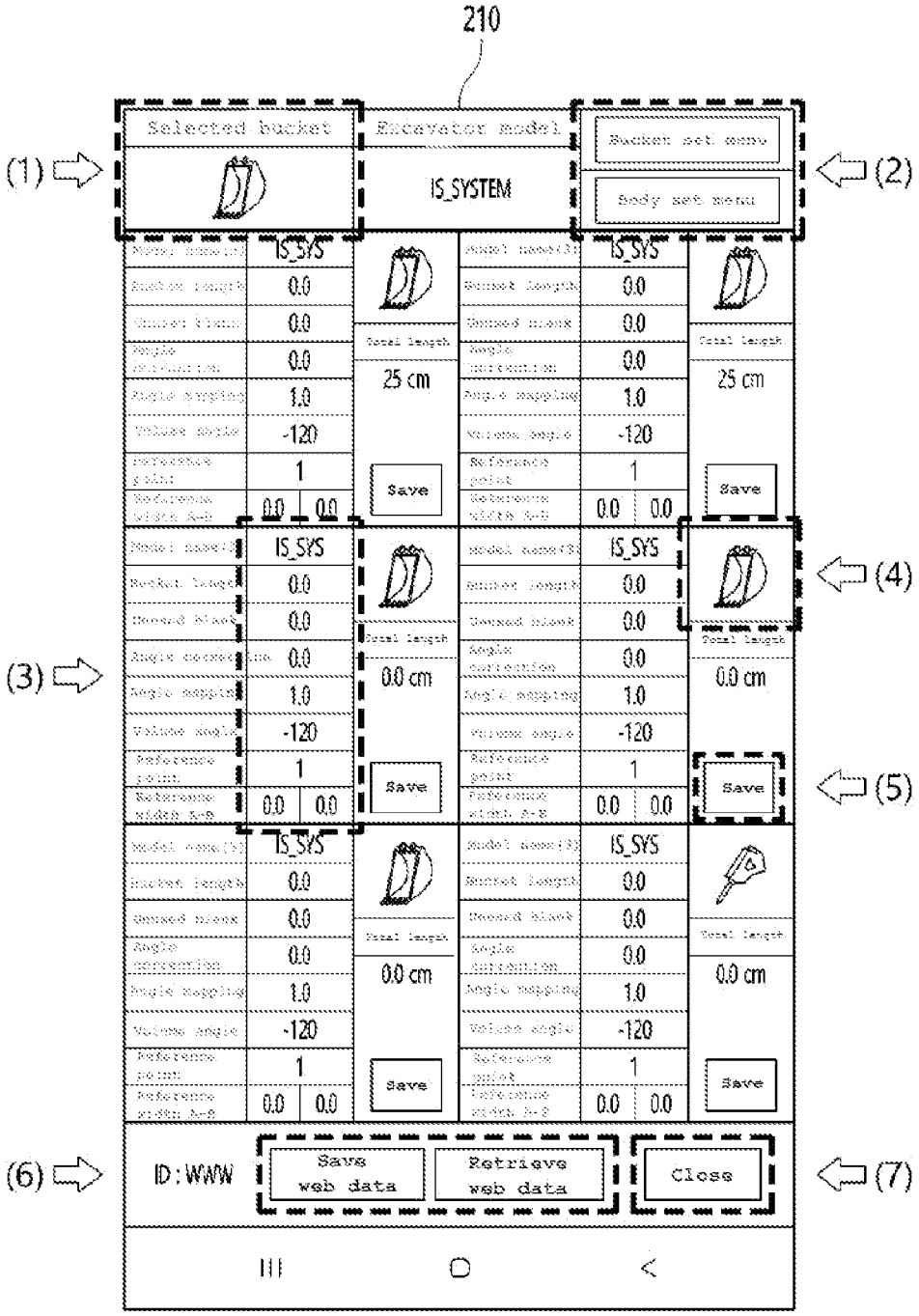
FIG. 9 is a schematic view showing a bucket setting screen displayed on the interface unit.

FIG. 9 is a schematic diagram showing a bucket setting screen displayed on the interface unit 200.

The bucket setting screen includes a first bucket menu (1) for displaying a selected bucket, a second bucket menu (2) for determining various settings, a third bucket menu (3) for inputting the use of the bucket, a fourth bucket menu (4) for providing a selection button of the bucket, a fifth bucket menu (5) for providing a button for storing the selected bucket in the interface 200 itself, a sixth bucket menu (6) for providing a button for storing the selected bucket in a web server, and a seventh bucket menu (7) for providing a button for closing the bucket setting screen and returning to the main screen.

Figure 10:
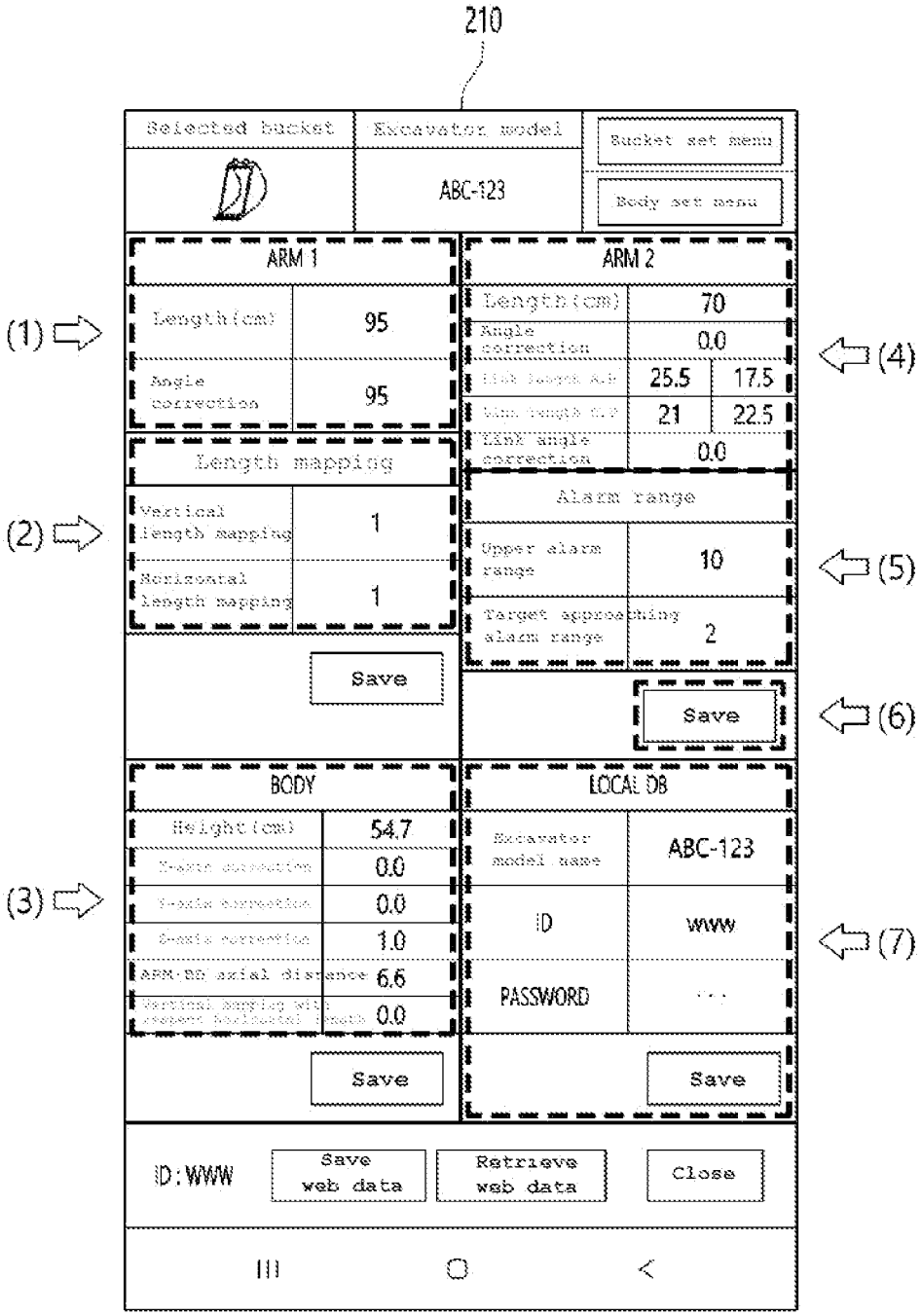
FIG. 10 is a schematic view showing a body setting screen displayed on the interface unit.

FIG. 10 is a schematic diagram showing a body setting screen displayed on the interface unit 200.

The body setting screen includes a first body menu (1) for inputting the specification of the first work implement, a second body menu (2) for inputting a correction value of the length error of the first work implement, a third body menu (3) for inputting the specification of the body 3, a fourth body menu (4) for inputting the specification of the second work implement, a fifth body menu (5) for inputting the range value of an alarm, a sixth body menu (6) for providing a button for storing various information received from the first to fifth body menus, and a seventh body menu (7) for inputting user information.

As shown in FIGS. 8, 9, and 10, the screen menus of the interface unit 200 may be variously changed, and further, the values on the menus may be changed appropriately according to various purposes.

Figure 11:
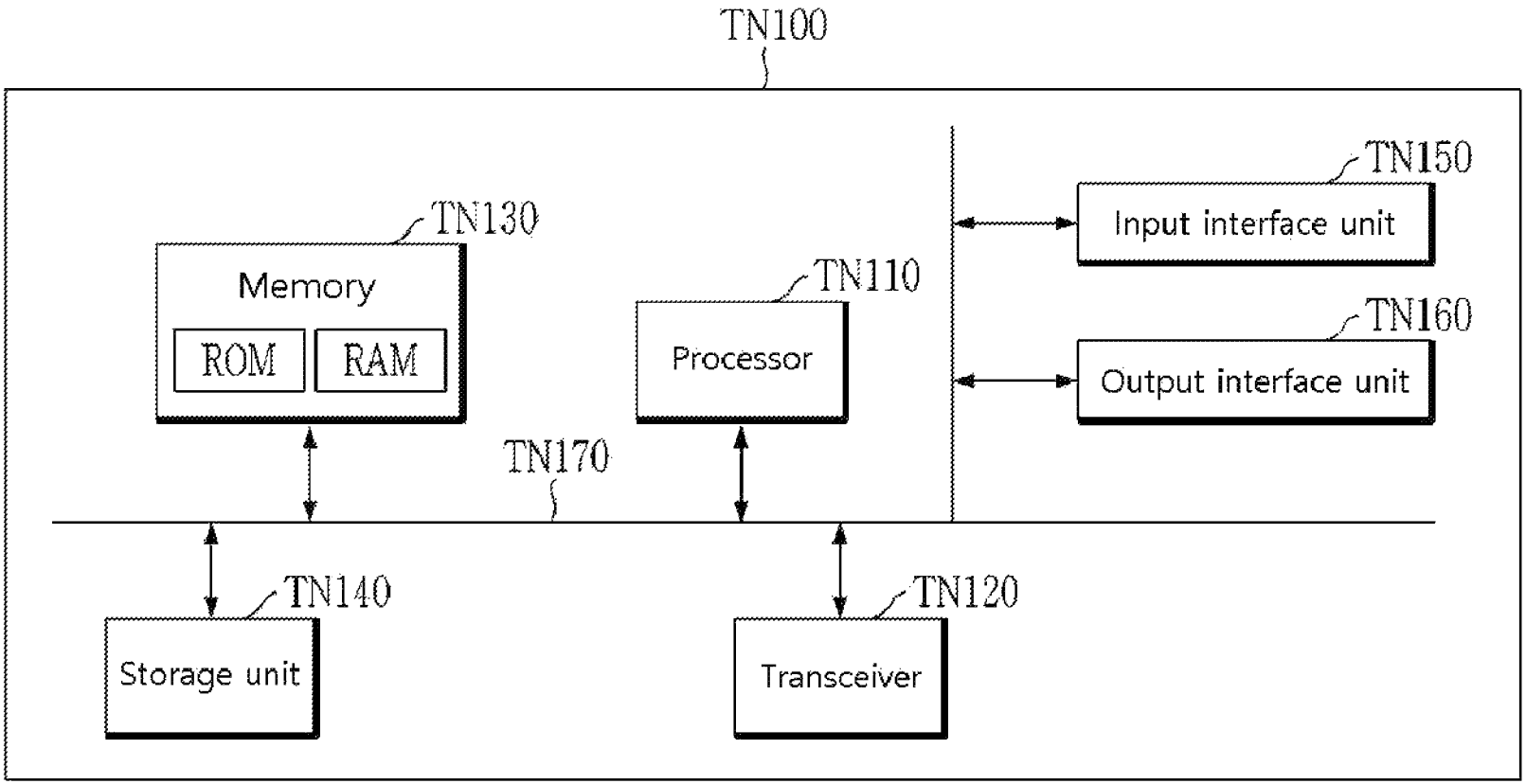
FIG. 11 is a block diagram showing a computing device according to an embodiment of the present invention.

FIG. 11 is a diagram showing a computing device according to another embodiment of the present invention. The computing device TN100 as shown in FIG. 11 may be the device (for example, the detection device, the interface unit, etc.) described herein.

According to the embodiment of the present invention, as shown in FIG. 11, the computing device TN100 includes at least one processor TN110, a transceiver TN120, and a memory TN130. Further, the computing device TN100 includes a storage unit TN140, an input interface unit TN150, and an output interface unit TN160. The components of the computing device TN100 are connected with one another by means of a bus TN170 so that they communicate with one another.

The processor TN110 executes a program command stored in at least one of the memory TN130 and the storage unit TN140. The processor TN110 may be a central processing unit (CPU), a graphics processing unit (GPU), or a dedicated processor in which methods according to the embodiment of the present invention are performed. The processor TN110 is configured to execute the procedures, functions, and methods described in the embodiment of the present invention. The processor TN110 controls the respective components of the computing device TN100.

Each of the memory TN130 and the storage unit TN140 serves to store various information related to the operations of the processor TN110. Each of the memory TN130 and the storage unit TN140 is configured as at least one of a volatile storage medium and a non-volatile storage medium. For example, the memory TN130 may be configured as at least one of read only memory (ROM) and random access memory (RAM). The transceiver TN120 transmits or receives a wired or wireless signal. The transceiver TN120 is connected to a network to perform communication.

Meanwhile, the embodiment of the present invention is not implemented only through the device and/or method described in the above, and may be implemented through a program that executes the functions corresponding to the configuration of the embodiment of the present invention or a recording medium in which the program is recorded. Such an implementation can be easily achieved through the above-described embodiment by those skilled in the art.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A detection device comprising:

an acquisition unit for acquiring posture information of a work implement having at least one of a bucket, an arm, and a boom of a construction equipment;

a first communication unit for transmitting the posture information to an interface unit as a target on which level information of the work implement is displayed;

a control unit for producing a zero point signal; and a second communication unit for communicating with other construction equipment, wherein:

the control unit produces the zero point signal if specific posture information is received from other construction equipment through the second communication unit;

the first communication unit transmits the specific posture information and the zero point signal to the interface unit; and the zero point signal controls the interface unit to allow specific level information on which the specific posture information is reflected to be set to a reference value; and the first communication unit assigns unique identifiers to pieces of detailed information constituting the posture information, wherein:

the first communication unit wirelessly transmits a packet comprising a set of the unique identifier and one of the pieces of detailed information to the interface unit; and the unique identifiers are used in restoring the posture information through combination of the pieces of detailed information in the interface unit.

2. The detection device according to claim 1, wherein the acquisition unit acquires position information of the construction equipment from a position determining means disposed in a body or control room of the construction equipment, the first communication unit transmits the position information to the interface unit, and the level information comprises at least one of the posture information, first processing information of the posture information, the position information, second processing information of the position information, and third processing information based on both of the posture information and the position information.

3. The detection device according to claim 1, wherein the first communication unit produces a packet where start notification, angle of the boom, angle of the arm, angle of the bucket, x-axis angle of the body of the construction equipment, y-axis angle of the body, z-axis angle of the body, latitude of the body, longitude of the body, altitude of the body, azimuth of the body, other information, and end notification are arranged in order mentioned and wirelessly transmits the packet to the interface unit.

4. The detection device according to claim 1, wherein the acquisition unit is connected to a wire line connected to an end sensor disposed on the end of the arm or the bucket or to a wire line connected to an intermediate sensor disposed on the center of the arm or the boom, and the first communication unit receives the posture information from the acquisition unit and wirelessly transmits the posture information to the interface unit as the target disposed in a control room of the construction equipment.

5. The detection device according to claim 1, wherein the acquisition unit and the first communication unit are mounted together in a casing disposed in a control room of the construction equipment, the acquisition unit is wiredly connected to sensors for sensing the posture information, and the first communication unit wirelessly transmits the posture information to the interface unit as the target disposed in the control room of the construction equipment.

6. The detection device according to claim 1, wherein the interface unit comprises a smart device having a display, a processing unit for processing the posture information to allow the processed posture information to be displayed on the display, and a terminal communication module for wireless communication with the first communication unit, the processing means converting the posture information into the level information that is displayed on the display using a level application corresponding to pre-distributed software, the terminal communication module transmitting the posture information to the first communication unit through Bluetooth or Wi-Fi, and the terminal communication module transmitting the posture information according to a protocol defined in the level application.

7. The detection device according to claim 1, wherein the first communication unit provides unique information to the interface unit and then transmits the posture information to a specific interface unit whose integrity for the unique information is authenticated.

8. The detection device according to claim 1, wherein a communication threshold range of the first communication unit is determined within a range of width and length of the construction equipment, and the first communication unit wirelessly communicates with a specific interface unit located in the corresponding construction equipment.

9. The detection device according to claim 1, wherein the control unit produces the zero point signal through a user's control, the first communication unit provides the zero point signal to the interface unit, and the zero point signal controls the interface unit to allow the specific level information being currently displayed to be set as a reference value.

10. The detection device according to claim 1, wherein the control unit produces the zero point signal for controlling the interface unit to allow the specific level information being currently displayed to be set as the reference value, a control room of the construction equipment is provided with a zero point control button operable by user's hand or a zero point control pedal operable by user's foot, and the control unit produces the zero point signal if the zero point control button or the zero point control pedal operates by an user.

11. The detection device according to claim 1, wherein the first communication unit transmits the specific posture information provided to the interface unit or obtained through the acquisition unit at the time when the zero point signal is produced to the second communication unit, and the second communication unit transmits the specific posture information to other construction equipment.

* * * * *